United States Patent [19]

Blanton et al.

[11] 4,304,965

[45] Dec. 8, 1981

[54] DATA CONVERTER FOR A SPEECH SYNTHESIZER

[75] Inventors: Keith A. Blanton; George R. Doddington, both of Richardson, Tex.

[73] Assignee: Texas Instruments Incorporated, Dallas, Tex.

[21] Appl. No.: 42,737

[22] Filed: May 29, 1979

[51] Int. Cl.[3] ..... G10L 1/00

[52] U.S. Cl. ..... 179/1 SA; 179/1 SM; 340/347 DD; 364/724

[58] Field of Search ..... 179/1 SA, 1 SM; 364/723, 724, 725; 340/347 DD

[56] References Cited

U.S. PATENT DOCUMENTS

| | | | |
|---|---|---|---|
| 3,952,164 | 4/1976 | David et al. | 179/1 SA |
| 3,975,587 | 8/1976 | Dunn et al. | 179/1 SA |
| 4,058,676 | 11/1977 | Wilkes et al. | 179/1 SA |

OTHER PUBLICATIONS

B. Gold, "Digital Speech Networks", Proc. IEEE, Dec. 1977, pp. 1635–1658.

L. Rabiner et al., "A Hardware Realization Etc.", IEEE Trans. Comm. Tech., Dec. 1971, pp. 1016–1020.

F. Itakura et al., "Digital Filtering Techniques Etc.", Seventh Intern'l Congress on Acoustics, Budapest, 1971, pp. 261–264.

S. Smith, "Single Chip Speech Synthesizers", Computer Design, Nov. 1978, pp. 188, 190, 192.

R. Wiggins et al., "Three Chip System", Electronics, Aug. 31, 1978, pp. 109–116.

N. Bodley, "Here's a breakthrough—a low cost synthesizer etc.", Elec. Design, Jul. 19, 1978, p. 32.

*Primary Examiner*—Mark E. Nusbaum
*Assistant Examiner*—E. S. Kemeny
*Attorney, Agent, or Firm*—William E. Hiller; Melvin Sharp; James T. Comfort

[57] ABSTRACT

Data converter for a speech synthesizer system wherein encoded formant parameters as stored in a memory are decoded and transformed or converted to reflection coefficients in real time by means of a circuit implementing a Taylor series type approximation. The reflection coefficients are then quantized and input to a speech synthesizer which utilizes quantized reflection coefficients to synthesize speech. The use of the coded formant frequency speech data which inherently contains more speech intelligence than reflection coefficient speech data enables a speech synthesizer system which utilizes quantized reflection coefficients to operate at a significantly lower bit rate than would otherwise be possible where reflection coefficients are employed as the speech data stored in the memory.

26 Claims, 3 Drawing Figures

DATA CONVERTER FOR A SPEECH SYNTHESIZER

BACKGROUND

This invention relates to a data converter for use in a speech synthesizer system, wherein encoded formant frequency data as received by the data converter is decoded and transformed or converted to reflection coefficients in real time. More specifically, the data converter is employed in a speech synthesizer system which generates speech from quantized reflection coefficients, the data converter including circuitry implementing a Taylor series type approximation in transforming encoded formant frequency data stored in memory to reflection coefficients in real time for utilization by the speech synthesizer so as to significantly reduce the operable bit rate normally required by the speech synthesizer to produce speech of acceptable quality when the speech data stored in memory is representative of reflection coefficients.

Speech synthesizers are known in the prior art. It is common for speech synthesizers to synthesize the human vocal tract by means of a digital filter, with reflection coefficients being utilized to control the characteristics of the digital filter. Examples include U.S. Pat. Nos. 3,975,587 and 4,058,676. While the utilization of reflection coefficients as filter controls will allow fairly accurate speech synthesis, the bit rates required are typically 2400–5000 bits per second. Recently, an integrated circuit device manufactured by Texas Instruments Incorporated of Dallas, Tex., demonstrated the ability to synthesize speech utilizing reflection coefficient-type data, at a rate of 1200 bits per second. The aforementioned device is disclosed in U.S. patent application Ser. No. 901,393, which was filed Apr. 28, 1978, now U.S. Pat. No. 4,209,836 issued June 24, 1980.

Reflection coefficient-type data can be derived by extensive mathematical analysis of certain formant frequencies and bandwidths of human speech. However, the analysis required is quite time consuming and is not suitable for real time calculation without the use of a high-level computer system. Therefore, although formant frequency data contains more inherent speech intelligence than reflection coefficient data, the inability to convert formant frequency data to reflection coefficient data on a real time basis has been an obstacle to low bit rate speech synthesis systems which utilize formant frequency data.

It is, therefore, one object of this invention to implement a low bit rate speech synthesizer system which utilizes reflection coefficient data.

It is another object of this invention to provide an improved apparatus for converting formant frequency data to reflection coefficient data, in real time.

In accordance with the present invention, a data converter is provided for use in a speech synthesizer system which relies upon quantized reflection coefficients for the generation of speech, wherein the data converter accepts encoded formant frequency speech data, decodes the formant frequency speech data, and transforms the decoded data into reflection coefficients in real time via circuitry implementing a Taylor series type approximation. The speech synthesizer of the system utilizes the reflection coefficients as derived from the encoded formant frequency data by the data converter in producing speech of acceptable quality while operating at a significantly reduced bit rate than that it would normally require when the digitized speech data stored in memory for use by the speech synthesizer is representative of reflection coefficients. The reduced bit rate operation is achievable because formant frequency data contains more speech intelligence for a comparable string of data bits than reflection coefficient data. Thus, the speech synthesizer utilizing quantized reflection coefficients to generate speech as disclosed in U.S. Pat. No. 4,209,836 which ordinarily operates at a rate of 1200 bits per second can be operated at the significantly reduced rate of approximately 300 bits per second when employing encoded formant frequency speech data and the data converter as constructed in accordance with the present invention. A bit sequence of approximately 300 bits per second, consisting of coded pitch, energy and formant center frequencies is decoded by the data converter and the formant center frequency data is transformed in real time into reflection coefficients which are then quantized and input to the speech synthesizer.

In another more specific aspect of the speech synthesis system, formant frequency data is encoded in memory for only the voiced speech regions and reflection coefficients data is encoded in memory for the unvoiced speech regions. The speech synthesis system reads the encoded bit sequence from memory and decodes it to obtain the speech synthesis filter parameters as needed. During voiced speech, the decoded formant center frequencies and bandwidths are transformed by the data converter into reflection coefficients, the conversion being effected through a table look-up transformation wherein values for each reflection coefficient are stored in a ROM table for a suitable number of combinations of the first three formant center frequencies. Linear interpolation is employed to approximate the reflection coefficients for formant center frequencies which are not included in the look-up table. The decoded unvoiced speech is already in the form of reflection coefficients and together with the converted formant center frequencies and bandwidths is processed as quantized reflection coefficients and input to the speech synthesizer for generating speech.

BRIEF DESCRIPTION OF THE DRAWINGS

The novel features believed characteristic of the invention are set forth in the appended claims. The invention itself, however, as well as a preferred mode of use and further objects and advantages thereof, will best be understood by reference to the following detailed description of an illustrated embodiment when read in conjunction with the accompanying drawings:

DETAILED DESCRIPTION OF A SPECIFIC EMBODIMENT

Figure 1A:
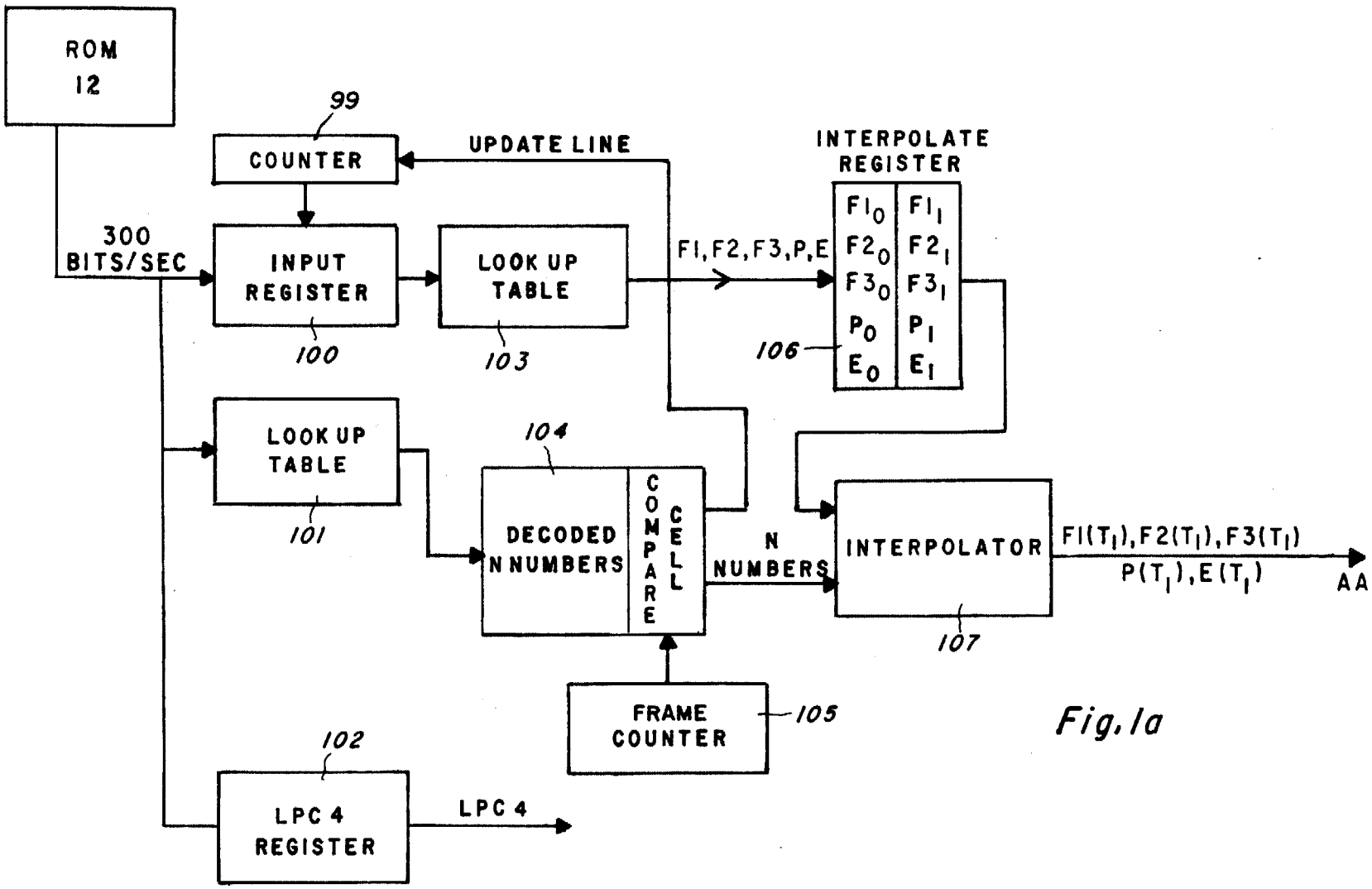
FIGS. 1*a* and 1*b* depict a block diagram illustrating the major components of the data converter.

The Speech Synthesizer Integrated Circuit Device of U.S. Pat. No. 4,209,836 assigned to the Assignee of this invention is a unique Linear Predictive Coding speech synthesizer which utilizes a revolutionary new digital filter. An embodiment of the aforementioned digital filter is capable of implementing a ten stage, two-multiplier lattice filter in a single stage. In such an embodiment, speech synthesis is accomplished by ten reflection coefficients which selectively control the characteristics of the filter to emulate the acoustic characteristics of the human vocal tract. These reflection coefficients are derived from an extensive analysis of human speech, and an average bit rate of 1200 bits per second is typically required to synthesize human speech with this system. Formant frequency data, which contains more inherent speech information, may be converted into the aforementioned reflection coefficients by utilizing the data converter of this invention and high quality synthetic speech may be generated with a data rate of as low as 300 bits per second, for example. Accordingly, U.S. Pat. No. 4,209,836 is hereby incorporated herein by reference.

THEORY OF OPERATION

As previously discussed, the prior art procedure for conversion of formant center frequencies and bandwidths to reflection coefficients is a complicated and time consuming process and is not normally suitable for real time synthesis using a monolithic semiconductor device or even using a medium size computer. The algorithm for converting predictor equation coefficients to reflection coefficients, for example, requires 140 integer additions, 65 real additions, 65 real multiplications and 55 real divisions for a 10th order system. Therefore, a much simpler transformation must be available if real time synthesis is to be performed.

Utilizing a four formant system in accordance with an embodiment of the present invention, it has been found that high quality synthetic speech can be produced if the formant band widths and the center frequency of the fourth formant are assigned fixed values.

In this embodiment, values for the bandwidths are nominally selected to be $B_1=75$ Hz, $B_2=50$ Hz, $B_3=100$ Hz and $B_4=100$ Hz. If a value substantially less than one of the above values is utilized (greater than 30% less), a buzziness is present in the synthesized speech. Presumably, this results from the impulse response being unnaturally long for human speech. If a value substantially greater than one of the above values is utilized, the synthesized speech has a muffled quality since the formant is not sharply defined. These values are in reasonable agreement with the average values $B_1=80$ Hz, $B_2=80$ Hz, $B_3=100$ Hz obtained by Gunnar Fant in "On Predictability of Formant levels and Spectrum Envelopes from Formant Frequencies," *For Roman Jakobson,* Morton and Co, 1956. Through examination of spectrograms from a number of test phrases and words, the fourth formant center frequency was assigned the value of 3300 Hz. The intensity of the fourth formant is very weak in synthesized speech since the first, second and third formants cause the filter frequency response magnitude to drop 36 db per octave for frequencies greater than the third formant. Thus, if the value assigned to $F_4$ is too great, the fourth formant will be eliminated completely, and if the value assigned to $F_4$ falls within the range of possible values of $F_3$, an unnatural resonance may occur. Using the aforementioned fixed values, each reflection coefficient $K_i$ is a function of the first three formant center frequencies, $F_1$, $F_2$ and $F_3$. By using a Taylor series expansion, it is possible to express equation (1) as approximately equal to equation (2) where $K_i$ is known for $F_1=F_{10}$, $F_2=F_{20}$ and $F_3=F_{30}$ $$K_i=f_i(F_1,F_2,F_3) \quad (1)$$

$$K_i=f_i(F_{10},F_{20},F_{30})+(\partial f_i/\partial F_1)(F_{10},F_{20},F_{30})(F_1-F_{10})+(\partial f_i/\partial F_2)(F_{10},F_{20},F_{30})(F_2-F_{20})+(\partial f_i/\partial F_3)(F_{10},F_{20},F_{30})(F_3-F_{30}) \quad (2)$$

Therefore, if $K_i$ is known for a suitable number of values of $F_1$, $F_2$ and $F_3$, linear interpolation may be used to approximate $K_i$ for values of $F_1$, $F_2$ and $F_3$ which are not known. To prevent unstable filter coefficients, the absolute values of $K_i$ found utilizing this method are constrained to be less than one. Additionally, the partial derivatives $\partial f/\partial$ may be precalculated and stored in a table to minimize actual computation during synthesis.

OPERATION

Figure 1B:
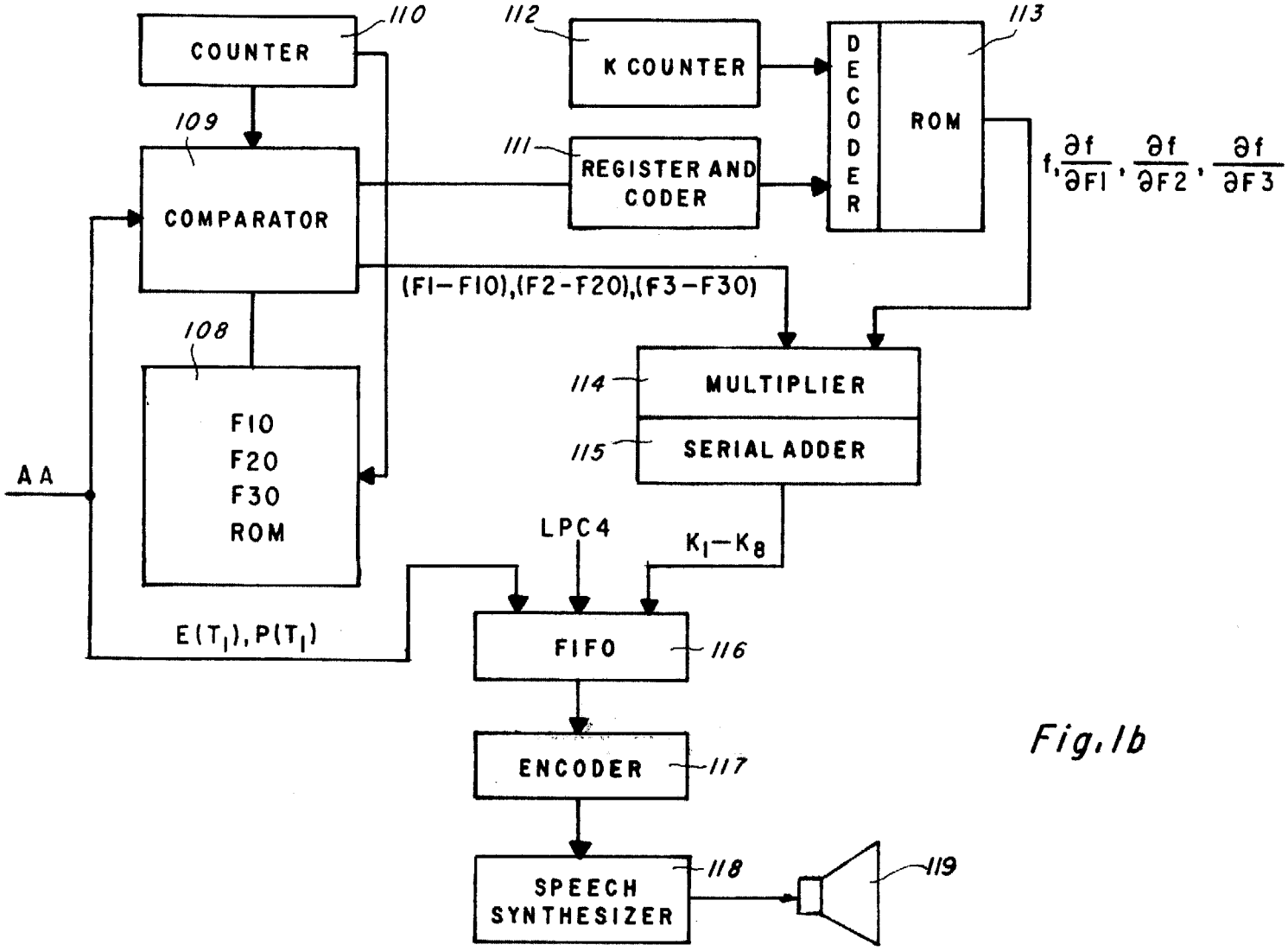
Figure 2:
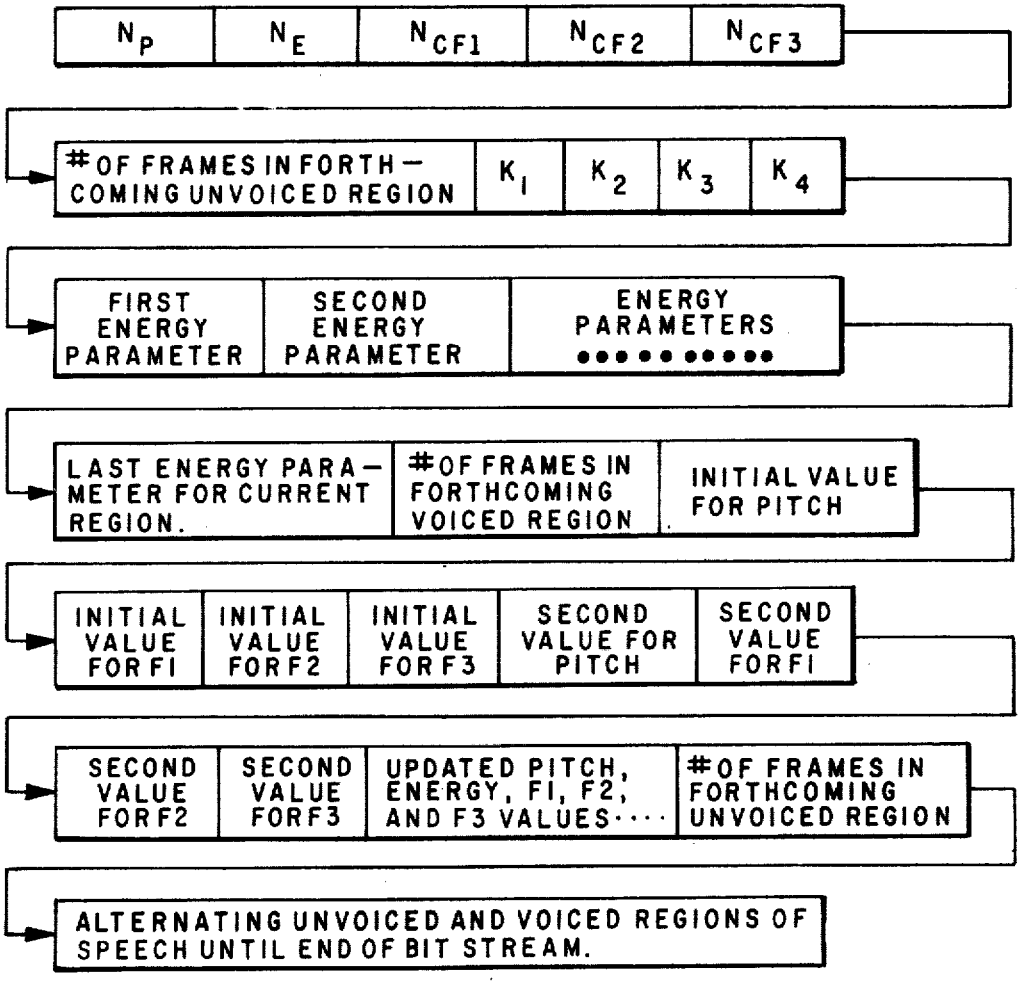
FIG. 2 depicts a sample bit sequence utilized with the data converter.

Referring now to FIGS. 1*a* and 1*b*, a logic block diagram illustrating the major components of an embodiment of the data converter is shown. In the present embodiment, a 300 bit per second stream of coded data from ROM 12 is applied to input register 100, lookup table 101 and LPC4 register 102. Each sequence of data is preceded by certain spacing parameters or N numbers. These spacing parameters are coded digital numbers which indicate how many frames are contained in the sequence and at what frame rate each specific parameter will be updated during the sequence. Preferably, in the embodiment disclosed, it is more efficient to transmit only those parameters which have changed substantially during a given speech region of the sequence. Experimentation has shown that high quality speech may be synthesized where typically the spacing parameters are equal to eight frames of data, and usually range from five to ten frames. An additional coded factor identifies the sequence as voiced or unvoiced speech. A sample bit sequence is shown in FIG. 2.

UNVOICED SPEECH

During unvoiced speech, the synthesizer of U.S. Pat. No. 4,209,836 utilizes reflection coefficients $K_1$ through $K_4$. Since unvoiced speech does not consist of formant frequency data, but rather a broad spectrum of "white noise", these four reflection coefficients are sufficient to synthesize unvoiced speech. When the data converter of this invention detects an unvoiced frame of speech, the LPC4 register 102 receives the reflection coefficients $K_1$-$K_4$, and directly, without conversion, inputs these reflection coefficients into FIFO buffer 116. These coefficients are then encoded into a form acceptable by the synthesizer of U.S. Pat. No. 4,209,836 by encoder 117 and are inputted to the synthesizer along with the pitch and energy parameters.

VOICED SPEECH

During voiced speech frames, lookup table 101 decodes the spacing parameters N and inputs the spacing parameters into compare cell 104. Compare cell 104 is clocked by frame counter 105 and as each frame is generated, checks to determine whether that particular frame is one in which a parameter will be updated, and identifies which parameter will be updated. The update line controls counter 99 which allows input register 100 to latch in the coded value of a given changing parameter. Lookup table 103 decodes the outputs of register 100 and provides actual values of pitch, energy and formant data to interpolate register 106. These initial values of pitch, energy and formant frequency are stored as target values, and the entire procedure is repeated. Once two successive values of each parameter are present in interpolate register 106, interpolator 107 performs standard interpolation mathematics to generate a constant stream of speech parameters at the desired rate. Interpolator 107 also has as an input the spacing parameters N from compare cell 104. This is because it is preferable, in this embodiment, that certain parameters be updated more frequently than others. Therefore, the spacing parameters are necessary inputs in order to determine how many interpolations are required between each of two successive values of any given parameter to generate a constant, regular stream of all speech parameters. Pitch and energy factors are coupled out of interpolator 107 and latched into FIFO buffer 116, to await the processing of the interpolated formant frequency data into reflection coefficients.

FORMANT FREQUENCY DATA CONVERSION

Read-Only-Memory 108 stores a selection of values for certain predetermined formant center frequencies. Comparator 109 latches in the first formant center frequency and performs a full iteration through ROM 108 to determine the "best match" of available stored values for that formant. The chosen value is latched out to register and coder 111 and the error signal, or the difference between the actual values of the first formant and the stored "best match" is outputted to multiplier 114. This action is repeated for the second and third formants. Experimentation has shown that as few as three possible values for the first two formant center frequencies and two values for the third, when stored in ROM 108, can produce acceptable quality synthetic speech with this invention. Register coder 111, after latching in all three formant frequencies, provides a coded representation of that particular combination to decoder and ROM 113, to act as a partial address for the location of the precalculated values of $f_i$ and $\partial f_i/\partial F_1$ $\partial f_i/\partial F_2$ and $\partial f_i/\partial F_3$ within ROM 113. These values are the translated reflection coefficient for each of the "best match" formants and partial derivatives thereof. K counter 112 provides the remainder of the address for ROM 113 by iteration through the desired reflection coefficient numbers $K_1$–$K_8$. The embodiment of the speech synthesizer described in detail in U.S. Pat. No. 4,209,836 utilizes ten reflection coefficients, $K_1$–$K_{10}$; however, it has been determined by the present inventors that fixed values for $K_9$ and $K_{10}$ do not significantly degrade the quality of speech generated by the synthesizer of U.S. Pat. No. 4,209,836 when utilized in combination with this invention. Thus, eight reflection coefficients are used for each of the eighteen possible combinations of formant center frequencies ($3\times3\times2$); since four values are stored for each reflection coefficient ($f_i$, $\partial f_i/\partial F_1$, $\partial f_i/\partial F_2$, $\partial f_i/\partial F_3$), the memory requirement for ROM 113 is only 576 bytes ($18\times8\times4$). As each reflection coefficient, or "K value" is addressed in ROM 113 for the current combination of formant frequencies, the values for $f_1$, $\partial f_i/\partial F_1$, $\partial f_i/\partial F_2$, and $\partial f_i/\partial F_3$ are latched out to multiplier 114. Multiplier 114 multiplies each of the partial derivatives with the appropriate error signal outputted from comparator 109, and serial adder 115 sums the product of these multiplications. Therefore, the output of serial adder 115 is the solution to Equation (2). And thus the action of multiplier 114 and serial adder 115 converts the known reflection coefficients and the error signals into appropriate reflection coefficients which correspond to the input formant frequencies. Each value of $K_i$ for $i=1=8$ is calculated and latched into FIFO buffer 116. When an entire frame of data is latched into FIFO buffer 116, it is encoded into the quantized reflection coefficients form as required by the synthesizer of U.S. Pat. No. 4,209,836 by encoder 117 and input to the synthesizer 118 where it is converted to an electrical analog signal which drives sound production means, including a tranducer, which may be in the form of a speaker 119, to produce audible speech.

As is the case for the speech synthesizer disclosed in U.S. Pat. No. 4,209,836, the data converter herein disclosed may be implemented as a monolithic semiconductive circuit device in an integrated circuit using conventional processing techniques, such as for example conventional P-channel MOS technology.

ALTERNATE EMBODIMENTS

While the data converter of this invention is disclosed in conjunction with the speech synthesizer of U.S. Pat. No. 4,209,836, it will, of course, be appreciated by those skilled in the art that a real time conversion circuit for converting formant center frequency data to speech synthesizer control information will find application in any speech synthesizer which utilizes such filter control coefficients. A mere modification of the encoding circuitry of encoder 117 will render this invention useful for systems which utilize autocorrelation coefficients or partial autocorrelation coefficients in addition to the quantized reflection coefficient system presently disclosed. It is therefore contemplated that the appended claims will cover these and other modifications or embodiments that fall within the true scope of the invention.

What is claimed is:

1. A speech synthesizer system comprising:

memory means for storing selected formant frequency data obtained by analysis of human speech;

data converter means coupled to said memory means for converting said formant frequency data into digital filter control data, said data converter comprising:

input means for receiving a plurality of input sets of formant frequencies from said first-mentioned memory means, second memory means for storing predetermined model sets of formant frequencies, comparison means coupled to said input means and said second memory for determining a selected one of said model sets of formant frequencies which most nearly approximates a respective one of said input sets of formant frequencies received by said input means, error signal generation means coupled to said input means and said comparison means for generating an error signal indicative of the differences between said selected one of said model sets of formant frequencies and said input set of formant frequencies, transformation means coupled to said comparison means for transforming said selected one of said model sets of formant frequencies to a model set of digital filter control data, and correction means coupled to said transformation means and said error signal generation means for correcting said model set of digital filter control data in response to said error signal to a set of digital filter control data associated with said input set of formant frequencies;

synthesizer means, including a digital filter coupled to said data converter means, for producing an analog signal reproduction of human speech, at the output of said digital filter, in response to said corrected set of digital filter control data; and sound production means, including a transducer, for converting said analog signal representative of human speech to an audible signal.

2. A speech synthesizer system as set forth in claim 1, wherein said corrected set of digital filter control data comprises quantized reflection coefficients.

3. A data converter for converting sets of formant frequencies obtained by analysis of human speed into digital filter control data, said data converter comprising:

input means for receiving a plurality of input sets of formant frequencies;

interpolation means coupled to said input means for receiving successive sets of formant frequencies to provide an interpolated output of formant frequency speed parameters as interpolated sets of formant frequency data;

memory means for storing predetermined model sets of formant frequencies;

comparator means coupled to said interpolation means and said memory means for determining a selected one of said model sets of formant frequencies from said memory means which most nearly approximates a respective one of said interpolated sets of formant frequency data being considered by said comparator means;

storage means coupled to said comparator means for successively storing a plurality of interpolated sets of formant frequency data to provide a particular combination of plural formant frequencies;

digital filter control data counter means;

transformation memory means coupled to said storage means and said digital filter control data counter means for receiving respective partial addresses collectively locating selected predetermined values of transformation functions stored therein;

an arithmetic unit coupled to said transformation memory means for processing the selected predetermined values of transformation functions as the signal output therefrom to convert the signal output into digital filter control data corresponding to the input set of formant frequencies; and correction means coupled to said arithmetic unit for correcting the digital filter control data to provide a set of corrected digital filter control data associated with said input set of formant frequencies.

4. A data converter as set forth in claim 3, wherein said set of corrected digital filter control data comprises quantized reflection coefficients.

5. A data converter for converting sets of formant frequencies obtained by analysis of human speech into digital filter control data, said data converter comprising:

(a) input means for receiving a plurality of input sets of formant frequencies;

(b) memory means for storing predetermined model sets of formant frequencies;

(c) comparison means, coupled to said input means and said memory means, for determining a selected one of said model sets of formant frequencies which most nearly approximates a respective one of said input sets of formant frequencies received by said input means;

(d) error signal generation means coupled to said input means and said comparison means for generating an error signal indicative of the differences between said selected one of said model sets of formant frequencies and said input set of formant frequencies;

(e) transformation means coupled to said comparison means for transforming said selected one of said model sets of formant frequencies to a model set of digital filter control data; and (f) correction means, coupled to said transformation means and said error signal generation means for correcting said model set of digital filter control data in response to said error signal, to a set of digital filter control data associated with said input set of formant frequencies.

6. The data converter according to claim 5, wherein said data converter is integratable as a monolithic semiconductive circuit device.

7. The data converter according to claim 5 wherein said sets of formant frequencies are the center frequencies of the first three formants of human speech.

8. The data converter according to claim 5 wherein said digital filter control data are quantized reflection coefficients.

9. The data converter according to claim 7 wherein said model sets of formant frequencies are comprised of at least two different center frequencies for each of the first three formants of human speech.

10. The data converter according to claim 5 wherein said memory means is a read-only-memory.

11. The data converter according to claim 5 wherein said error signal generation means includes a subtractor means for subtracting said selected one of said model sets of formant frequencies from said input set of formant frequencies.

12. The data converter according to claim 5 wherein said transformation means is a read-only-memory which is selectively addressed by a number representative of said selected one of said model sets of formant frequencies.

13. The data converter according to claim 5 wherein said correction means includes a multiplier and a serial adder for correcting said model set of digital filter control data in response to said error signal 14. A speech synthesizer system comprising:

(a) memory means for storing selected formant frequency data obtained by analysis of human speech;

(b) data converter means coupled to said memory means for converting said formant frequency data to quantized reflection coefficients in real time;

(c) synthesizer means, including a digital filter coupled to said data converter means, for producing an analog signal reproduction of human speech, at the output of said digital filter, in response to said quantized reflection coefficients; and (d) sound production means, including a transducer, for converting said analog signal representative of human speech to an audible signal.

15. The speech synthesizer system according to claim 14 wherein said memory means is integratable as a monolithic semiconductive circuit device.

16. The speech synthesizer system according to claim 14 wherein said data converter means is integratable as a monolithic semiconductive circuit device.

17. The speech synthesizer system according to claim 14 wherein said synthesizer means is integratable as a monolithic semiconductive circuit device.

18. The speech synthesizer system according to claim 14 wherein said formant frequency data are the center frequencies of each of the first three formants of human speech.

19. A data converter for use with a speech synthesizer having a digital filter controlled by quantized reflection coefficients, said data converter comprising:

(a) input means for receiving formant frequency data obtained by analysis of human speech;

(b) digital converter circuit means coupled to said input means for converting said formant frequency data to quantized reflection coefficients in real time; and (c) output means coupled to said digital converter circuit means for outputting said quantized reflection coefficients to said digital filter.

20. The data converter according to claim 19, wherein said data converter is integratable as a monolithic semiconductive circuit device.

21. The data converter according to claim 19 wherein said formant frequency data are the center frequencies of the first three formants of human speech.

22. A speech synthesizer system comprising:

memory means for storing selected formant frequency data obtained by analysis of human speech;

data converter means coupled to said memory means for converting said formant frequency data into digital filter control data, said data converter comprising:

input means for receiving a plurality of input sets of formant frequencies from said first-mentioned memory means;

interpolation means coupled to said input means for receiving successive sets of formant frequencies to provide an interpolated output of formant frequency speech parameters as interpolated sets of formant frequency data, second memory means for storing predetermined model sets of formant frequencies, comparator means coupled to said interpolation means and said second memory means for determining a selected one of said model sets of formant frequencies from said second memory means which most nearly approximates a respective one of said interpolated sets of formant frequency data being considered by said comparator means, storage means coupled to said comparator means for successively storing a plurality of interpolated sets of formant frequency data to provide a particular combination of plural formant frequencies, digital filter control data counter means, transformation memory means coupled to said storage means and said digital filter control data counter means for receiving respective partial addresses collectively locating selected predetermined values of transformation functions stored therein, an arithmetic unit coupled to said transformation memory means for processing the selected predetermined values of transformation functions as the signal output therefrom to convert the signal output into digital filter control data corresponding to the input set of formant frequencies, and correction means coupled to said arithmetic unit for correcting the digital filter control data to provide a set of corrected digital filter control data associated with said input set of formant frequencies;

synthesizer means, including a digital filter coupled to said data converter means, for producing an analog signal reproduction of human speech, at the output of said digital filter, in response to said corrected set of digital filter control data; and sound production means, including a transducer, for converting said analog signal representative of human speech to an audible signal.

23. A speech synthesizer system as set forth in claim 22, wherein said corrected set of digital filter control data comprises quantized reflection coefficients.

24. A speech synthesizer system comprising:

memory means for storing voiced and unvoiced speech data respectively representative of selected formant frequency data and quantized reflection coefficients as obtained by analysis of human speech;

data converter means coupled to said memory means for converting said formant frequency data into quantized reflection coefficients representative of voiced speech data;

speech synthesizer means including a digital filter coupled to said data converter means and to said memory means for producing an analog signal reproduction of human speech at the output of said digital filter in response to said quantized reflection coefficients transmitted to said digital filter via said memory means and representative of unvoiced speech data and said quantized reflection coefficients directed to said digital filter via said data converter means as derived from formant frequency data representative of voiced speech data; and sound production means, including a transducer, for converting said analog signal reproduction of human speech to an audible signal.

25. A speech synthesizer system as set forth in claim 24, wherein said data converter means comprises:

input means for receiving a plurality of input sets of formant frequencies from said first-mentioned memory means;

second memory means for storing predetermined model sets of formant frequencies;

comparison means, coupled to said input means and said second memory means, for determining a selected one of said model sets of formant frequencies which most nearly approximates a respective one of said input sets of formant frequencies received by said input means;

error signal generation means coupled to said input means and said comparison means for generating an error signal indicative of the differences between said selected one of said model sets of formant frequencies and said input set of formant frequencies;

transformation means coupled to said comparison means for transforming said selected one of said model sets of formant frequencies to a model set of reflection coefficients data; and correction means, coupled to said transformation means and said error signal generation means for correcting said model set of reflection coefficients data in response to said error signal, to a set of quantized reflection coefficients associated with said input set of formant frequencies.

26. A speech synthesizer system as set forth in claim 24, wherein said data converter means comprises:

input means for receiving a plurality of input sets of formant frequencies from said first-mentioned memory means;

interpolation means coupled to said input means for receiving successive sets of formant frequencies to provide an interpolated output of formant frequency speech parameters as interpolated sets of formant frequency data;

second memory means for storing predetermined model sets of formant frequencies;

comparator means coupled to said interpolation means and said second memory means for determining a selected one of said model sets of formant frequencies from said second memory means which most nearly approximates a respective one of said interpolated sets of formant frequency data being considered by said comparator means;

storage means coupled to said comparator means for successively storing a plurality of interpolated sets of formant frequency data to provide a particular combination of plural formant frequencies;

reflection coefficient counter means;

transformation memory means coupled to said storage means and said reflection coefficient counter means for receiving respective partial addresses collectively locating selected predetermined values of transformation functions stored therein;

an arithmetic unit coupled to said transformation memory means for processing the selected predetermined values of transformation functions as the signal output therefrom to convert the signal output into reflection coefficients corresponding to the input set of formant frequencies; and correction means coupled to said arithmetic unit for correcting the reflection coefficients to provide a set of quantized reflection coefficients associated with said input set of formant frequencies.

* * * * *